United States Patent [19]

Maroszek

[11] Patent Number: 4,530,459

[45] Date of Patent: Jul. 23, 1985

[54] FOLDING CARRIER CARTON INCLUDING SPLIT COVER CLOSURE, REMOVABLE TRAYS AND BLANKS FOR MAKING SAME

[75] Inventor: Raymond V. Maroszek, Neenah, Wis.

[73] Assignee: James River - Norwalk, Inc., Norwalk, Conn.

[21] Appl. No.: 533,848

[22] Filed: Sep. 16, 1983

[51] Int. Cl.[3] ..... B65D 5/35

[52] U.S. Cl. ..... 229/23 R; 229/15; 229/44 R; 229/45 R; 229/52 B; 229/23 A

[58] Field of Search ..... 229/15, 52 B, 30, 23 A, 229/43, 44 R, 45 R, 23 R

[56] References Cited

U.S. PATENT DOCUMENTS

| | | | |
|---|---|---|---|
| 2,032,569 | 3/1936 | Fuller | 229/44 R |
| 2,675,168 | 4/1954 | Clark | 229/44 R |
| 3,093,294 | 6/1963 | Kusunoki | 229/52 B |
| 3,094,265 | 6/1963 | Hovland | 229/44 R |
| 3,096,012 | 7/1963 | Bryant et al. | 229/52 B |
| 3,416,719 | 12/1968 | Pilger | 229/52 B |
| 3,938,731 | 2/1976 | Ross, Jr. et al. | 229/44 R |
| 4,258,875 | 3/1981 | Sykora | 229/43 |
| 4,331,289 | 5/1982 | Killy | 229/52 B |
| 4,397,395 | 8/1983 | Pergande et al. | 229/52 B |
| 4,447,004 | 5/1984 | House et al. | 229/52 B |

*Primary Examiner*—Joseph Man-Fu Moy

*Attorney, Agent, or Firm*—Finnegan, Henderson, Farabow, Garrett & Dunner

[57] ABSTRACT

A collapsible, carrier carton comprises a split cover, overlay closure with self-erecting handles and a side panel/web flange lock. This web lock permits secure locking of the split cover closure into a flattened and closed configuration and secures the removable upper tray(s) in a locked position. The split cover closure includes opposite side member panels having self-erecting, interlocking male and female handles. One of these side member panels is of a greater than the other to permit a split cover closure overlap which prevents contamination of the container interior when the side panels are closed. The split cover closure also includes outwardly and downwardly folding, notched-out web flaps with alignment holes. Each of these web flaps interlocks in a corresponding contour-crease, inwardly biased, side panel, knife-cut web lock. The carrier carton includes removable upper trays with vent holes. Connected to either end of said trays are end walls and foldably connected, triangularly shaped web flanges alignment holes. These removable tray web flanges align with the corresponding split cover closure web flaps for locking engagement in the carrier carton side panel web locks. The carrier carton frame includes inwardly projecting lower flanges which are glued together to form a partial bottom support upon which a removable bottom tray closure is seated.

8 Claims, 10 Drawing Figures

36c
32
30

33c
34
31
33
35
20
27

21
26

16
18
10
12c
13
19
14c
17
15
7
8

FOLDING CARRIER CARTON INCLUDING SPLIT COVER CLOSURE, REMOVABLE TRAYS AND BLANKS FOR MAKING SAME

BACKGROUND OF THE INVENTION

The subject invention relates to a new and improved collapsible carrier carton which is of rigid, yet relatively inexpensive construction, storable in flattened condition, quickly and simply erected, and, while available for use in many applications, is primarily intended for use in fast-food, carryout applications.

Most fast-food carrier carton containers have only a single compartment. This presents a significant problem where different items are to be stored and where the container contents include, for example, deep fried food with a batter topping which has a tendency to become very soggy and stick together when packaged in a carryout container. In these circumstances, it is desirable to separate the contents and to provide adequate circulation within the container.

Most prior art containers are unsatisfactory for solving these problems. One representative state of the art carrier carton is illustrated by U.S. Pat. No. 4,230,261 to John J. Austin. The Austin patent shows only a single compartment which has no provision for interior venting and cannot be easily stacked when assembled because of its irregular, gable top construction. Accordingly, it is an object of this invention to spread the food out in separate layers, as opposed to being stacked on top of each other, and to provide adequate air circulation throughout the entire container. This invention, with its removable trays and associated vent openings, permits separation of the food and facilitates air circulation. These features prevent sogginess of both the food and the container, maintain crispness of the deep-fried, batter foods while, at the same time, provide excellent heat retention.

SUMMARY OF INVENTION

The present invention overcomes the problems and disadvantages of the prior art by providing a folding carrier carton comprised of:

(a) a split cover closure having a pair of oppositely disposed end cover panels wherein at least one of the cover panels includes a substantially triangular shaped web flap, and first and second oppositely disposed side cover panels wherein each of the side cover panels includes corresponding foldable handles adapted to interlock with each other in folded condition, and shoulder members adapted to overlap one another in folded condition wherein the shoulder members of the first side cover panel member are of a lesser dimension than the shoulder members of the second cover panel;

(b) a substantially rectangular frame interconnected to said split cover closure wherein the frame includes a corresponding pair of oppositely disposed side panels and a corresponding pair of oppositely disposed end panels wherein at least one of said end panels includes a web lock adapted to receive and secure the web flaps from the corresponding split cover panel; and (c) a bottom interconnected to the substantially rectangular frame.

It is also an object of this invention to provide a folding carrier carton that includes a partial bottom support which can be adapted to retain a removable, open-ended, sleeve-like lower tray platform that includes upper and lower surfaces, wherein the upper surface has vented openings. The use of such a removable lower tray facilitates both air circulation and retention of heat in the carrier carton.

Another object of this invention is to permit the use of removable upper trays which are adapted for locking engagement, together with the split cover-end panel-web flap/side panel-web lock. These removable trays facilitate food separation, air circulation and flexibility for accommodating a variety of container contents. All of these features prevent food container sogginess and create an aesthetically and culinary pleasing product.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

The accompanying drawings, which are incorporated in, and constitute a part of this specification, illustrate one embodiment of the invention and, together with the description, serve to explain the principles of the invention.

BRIEF DESCRIPTION OF THE DRAWINGS

FIG. 4 also shows the self-erecting handle in the normally biased upright position.

DESCRIPTION OF THE PREFERRED EMBODIMENT

Reference will now be made in detail to the present preferred embodiment of the invention, an example of which is illustrated in the accompanying drawings.

Figure 6A:
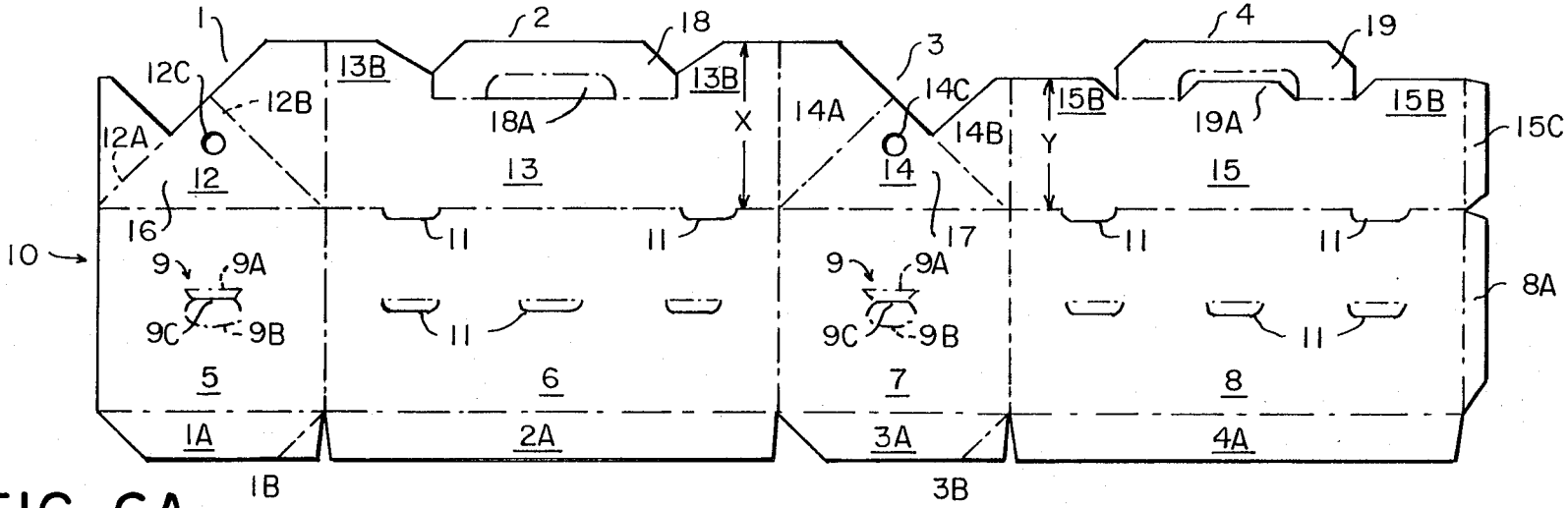
FIG. 6A is a drawing showing the boxboard blank from which the carrier carton is made with the fold lines shown as dotted lines.

FIG. 6A illustrates a single blank from which the carrier carton 10 is made. This blank may be cut from virtually any form of sheet material such as paperboard, solid bleach board, cardboard, polymer coated board (commonly referred to as "polyboard") or any other suitable foldable sheet material (hereafter referred to generally as boxboard). In the preferred embodiment, only one side of the boxboard is polymer coated to prevent the boxboard from becoming soggy from, or sticky with its contents. Depending upon use, however, either side may be coated or covered with any suitable surface material, such as aluminum foil, for example. Aside from the fact that coating adds to the expense, it is generally preferred to coat only one side, because an uncoated boxboard is easier to glue, and gluing is one of the preferred means for interlocking the various component parts. Other suitable locking means are staples and conventional "male and female" interlocks.

The boxboard blank shown in FIG. 6A includes a number of hingelike interlocking sections, the interior boundaries of which are always delineated by dotted "fold lines". These sections, when properly folded and interconnected, facilitate assemblage of the carrier carton 10 shown with its split cover open in FIG. 1A and closed in FIG. 4.

Figure 5:
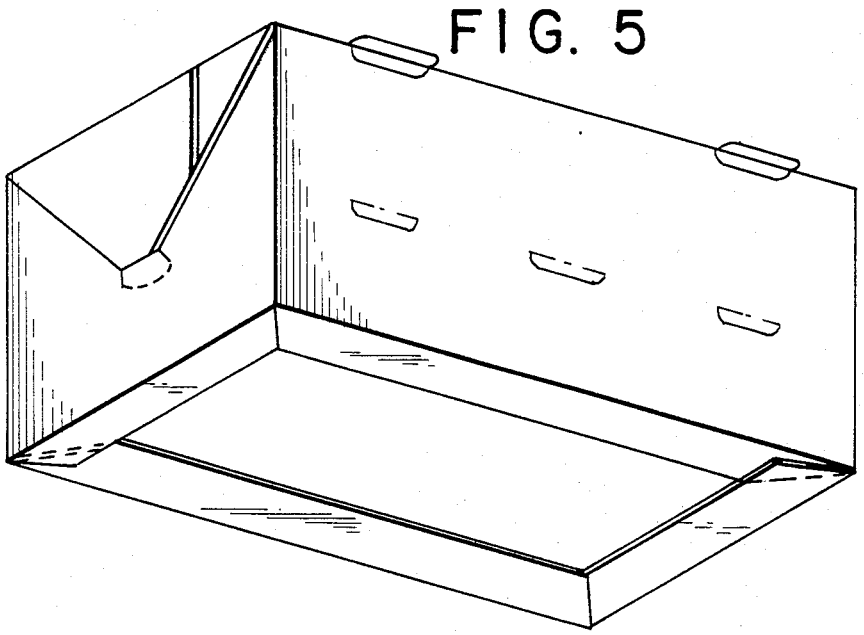
FIG. 5 is a perspective view of the carrier carton bottom showing a partial bottom.

More particularly, blank 10 includes a pair of oppositely disposed end sections, 1 and 3, and a pair of oppositely disposed side sections, 2 and 4. Each of sections 1 through 4 includes a lower flap (1A–4A, respectively), the interconnection of which, in rectangular fashion forms the carrier carton partial bottom shown in FIG. 5. While any suitable connecting means may be utilized to connect lower flaps 1A–4A, the preferred embodiment utilizes a cold glue applied to the innerside of folded tabs ("inner" being relative to the direction of blank close) 1B and 3B, respectively. Located directly above lower flaps 1A through 4A, and integrally connected thereto in hingelike fashion by dotted "fold lines", are a corresponding pair of oppositely disposed end panels, 5 and 7, and a corresponding pair of oppositely disposed side panels, 6 and 8. When panels 5, 6, 7 and 8 are integrally connected in assembled condition, they constitute a substantially rectangular frame structure. Each of end panels 5 and 7 includes an end panel weblock, both of which web locks are designated generally by the numeral 9. Each weblock is defined by an upper, substantially horizontal fold line (crease) in the end panel 9A and a lower contour or curved fold line (crease) 9B. Communicating directly with the ends of both the upper horizontal and lower contour creases are a pair of oppositely disposed "v-shaped slits" or knife cuts into the boxboard. These v-shaped knife cuts are joined at their respective verticies by a substantially horizontal knife cut 9C. The boxboard opening generated in the end panels, 5 and 7, by the intersecting knife cuts forms the web lock aperture into which the later described web flaps, 16 and 17, are rigidly retained and locked. Because the contour or curved crease 9B imparts more resistance to movement than does the upper, substantially horizontal crease 9A, the contour crease 9B imparts an inward and retaining bias or "lock" to an inserted web flap.

Side panels 6 and 8 also include cutout vents 11 which permit circulation of air within the enclosure to prevent sogginess and preclude contamination while still permitting an excellent heat retention characteristic. This is particularly important in fast food applications where the container contents typically include deep fried foods. Proper circulation not only prevents sogginess and staining of the boxboard, but also facilitates retention of a crispy texture to the deep fried food content. The vents shown in FIG. 6A are of substantially quadrangular configuration and are formed by knife cuts in the side panels other than along the fold line. As will be obvious to one skilled in the art, other vents, of various configurations and shapes, may be employed in other locations as necessary. However, this invention prefers the fold line vents shown in FIG. 6A because they automatically pop out when the split cover panels, 15 and 17, are closed, thereby forming a substantially horizontal roof which serves to prevent contamination of the carrier carton contents.

Figure 4:
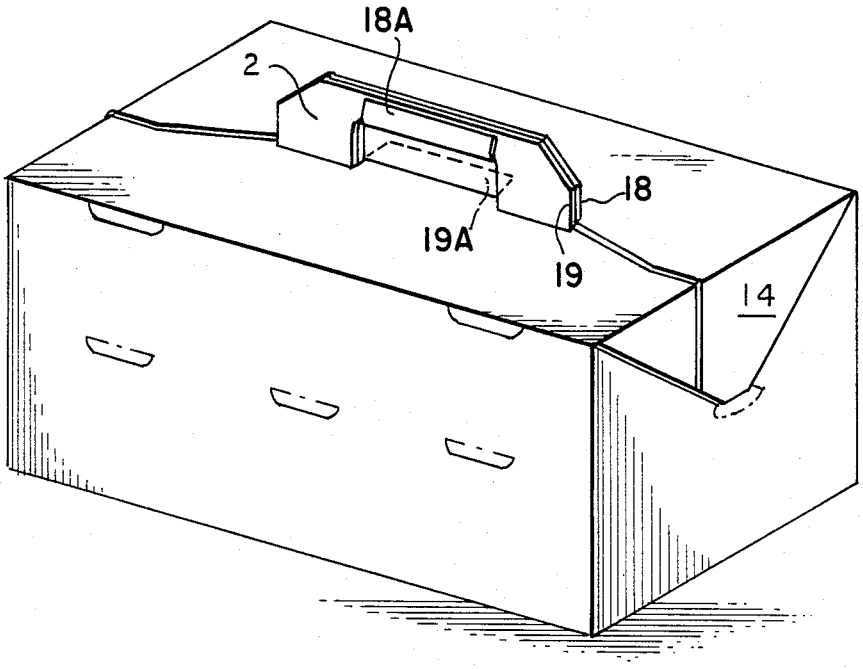
FIG. 4 shows a fully closed carrier carton with the end panel web flap securely engaged in the inwardly biased, contour-crease web lock, referred to generally as element 9.

While, as described elsewhere, other interlocking means may be employed, the invention prefers the use of a cold glue on the inner surface of flap 8A to connect side panels 5 and 8 when assembled in closed, rectangular fashion as shown in FIG. 4. Located above end panels 5 and 7 and side panels 6 and 8, respectively, and integrally, hingedly connected thereto by the fold lines shown in FIG. 6A, are oppositely disposed and corresponding pairs of end cover panels 12 and 14 and side cover panels 13 and 15, respectively. End cover panels 12 and 14 are mirror images of each other and include fold lines 12A and 12B and 14A and 14B, respectively, which unite to define triangular web flaps 16 and 17, respectively, the tip portion of which when folded downwardly and outwardly of the container in assembled condition is located to engage itself in the side panel weblocks 9 as shown in FIG. 4. Each of the triangular web flaps further includes an alignment hole at 12C and 14C, respectively. Additionally, end cover panels 12 and 14 each include a "notched out portion" defined by lines 12D and 12E and 14D and 14E, respectively. These notched out portions facilitate ready access to alignment holes 12C and 14C which makes closure of the split cover much easier.

Both side cover panels 13 and 15 include corresponding, self-erecting foldable handles 18 and 19 with conventional male and female cutout assemblies 18A and 19A, respectively, which are adapted to interlock with one another when in oppositely disposed, assembled condition as shown in FIG. 4. First side cover panel 13 includes shoulder members 13B which are of a dimension (x) greater than the dimension (y) for the corresponding shoulder members 15B of second side cover panel 15. The larger dimension (x) permits first side cover panel 13 to overlap second side cover panel 15 when carrier carton 10 is assembled in closed condition as shown in FIG. 4.

Figure 2:
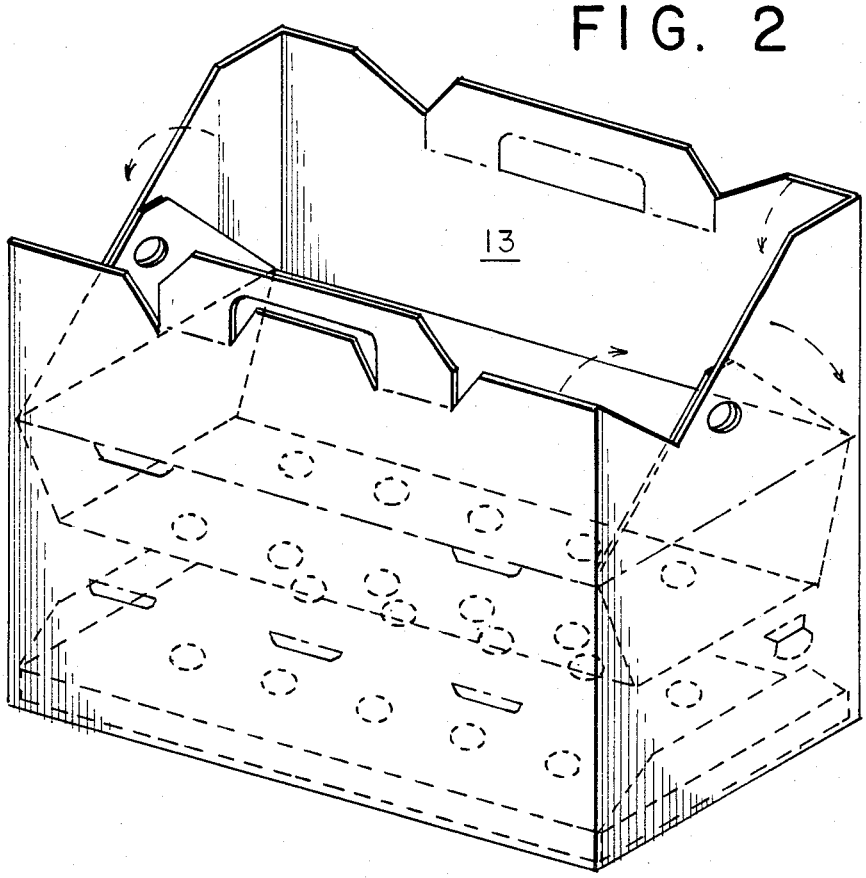
FIG. 2 is a perspective view which shows the pre-closure orientation of the carrier carton 10 with the inserted upper and bottom trays 30 and 20, respectively, shown in phantom. The arrows illustrate the directions of the split cover motions of closing movement.

Side cover panels 13 and 15 together constitute a split cover closure, the closing direction movements of which are illustrated by the arrows in FIG. 2. The overlap in the center of the carton prevents dust or other contamination from infiltrating the food or other contents of carrier carton 10. The interior of side cover panel flap 15C is cold glue coated to facilitate interlocking relationship with end cover panel 12.

When the pre-glued boxboard blank shown in FIG. 6A is interconnected as described above, it is fully collapsible into a flattened condition which makes it particularly suitable for shipping and storage.

Figures 1A, 1B, 1C:
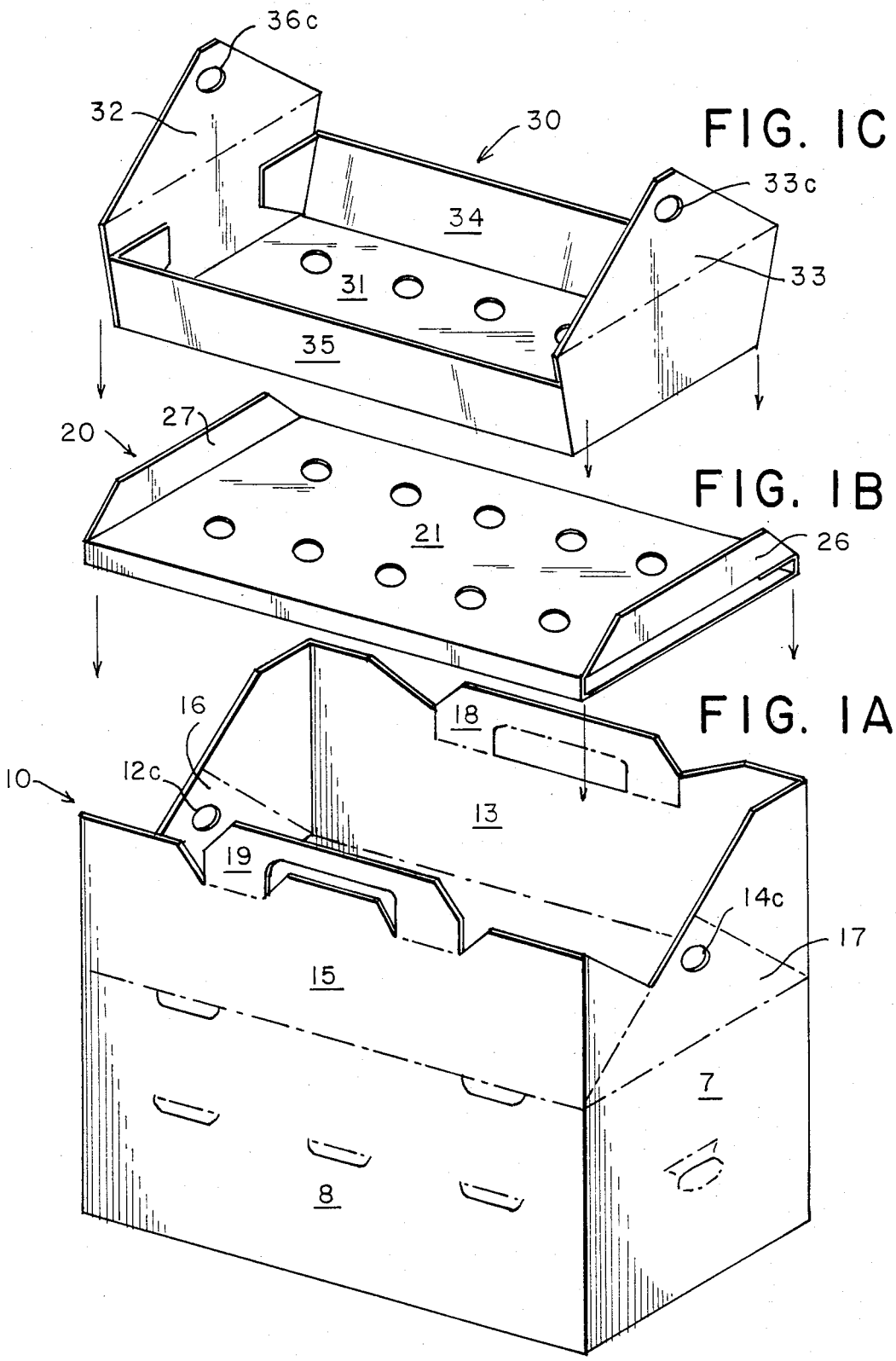
FIGS. 1A–C are a series of figures in telescoping perspective showing the three principal elements of the invention's preferred embodiment collapsible container, namely, the carrier carton 10, removable bottom tray 20 and removable upper tray 30.
Figure 6B:
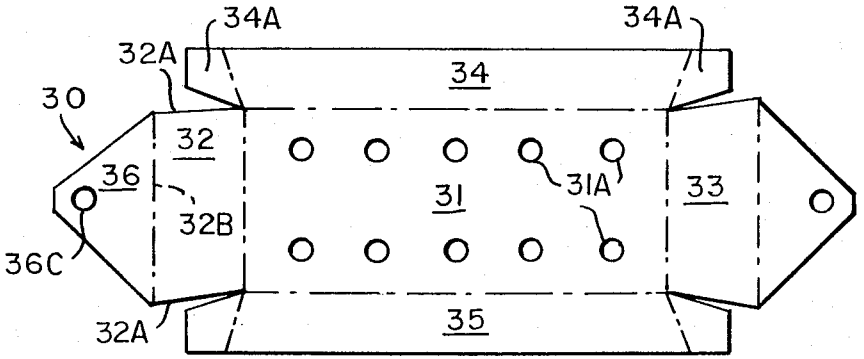
FIG. 6B is a drawing of the boxboard blank from which the removable upper tray is made.

FIG. 6B illustrates the boxboard blank from which the removable upper tray 30 is formed. Upper tray blank 30 includes a substantially rectangular bottom panel 31 joined at its rectangular defining fold lines by a pair of oppositely disposed end walls 32 and 33 and a pair of oppositely disposed side walls 34 and 35, respectively. Because the end walls and sidewalls are mirror images of each other, only one such member need be described in detail. Sidewall member 34 is substantially rectangularly shaped and has notched out side tabs 34A, the underside of which are cold glued so that, when assembled, can be interlocked with end walls 32 and 33, respectively, as shown in FIG. 1C. End wall member 32 is of quadrangular shape with outwardly flaring edges 32A and fold line 32B which is hingedly and integrally connected to a substantially triangularly shaped web flange 36, which flange includes an alignment hole 36C.

Figure 3:
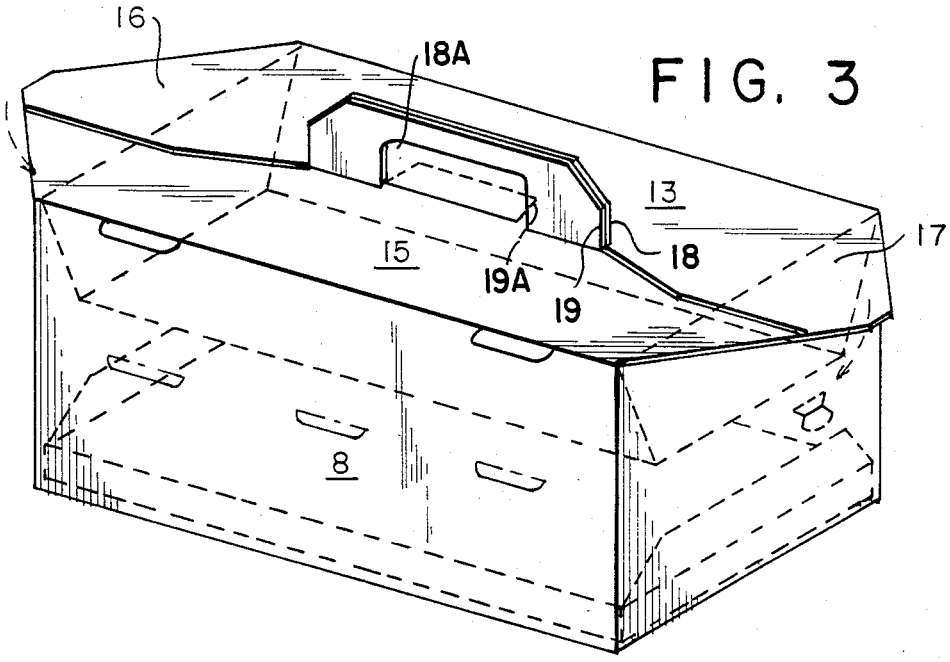
FIG. 3 is another perspective view showing the partially closed carrier carton with the aligned end webs and tray flanges being pulled outwardly and downwardly to close and lock the split cover.

Bottom panel 31 may also include at least one opening, and preferably a plurality of openings as illustrated by 31A in FIG. 6B to allow for proper circulation when the removable upper tray is assembled and housed within carrier carton 10 as shown by the phantom lines in FIGS. 2 and 3. Preferably, the upper side of upper tray 30 is coated to protect it from tray contents such as fried foods. It is not necessary that upper tray 30 include side wall members 34 and 35. However, said wall members not only serve to contain the upper tray contents when removed from the carrier carton, but also serve to enhance the upper tray strength by importing greater rigidity.

Alignment holes 12C and 14C in web flaps 16 and 17, respectively, are positioned to be aligned with alignment holes 36C in tray flanges 36. These corresponding alignment holes in the tray flanges and web flaps are important because they make it easy to insert the removable upper tray into the carrier carton by using the thumb and forefingers. The tray can then be secured in a fixed position by first bringing the corresponding web flap and tray flange holes into alingment and then pulling the aligned tray flanges and web flaps outwardly and downwardly and snapping the overlaid and aligned tray flange and web flaps into locked position with web-lock 9 as shown in FIG. 4.

Figure 6C:
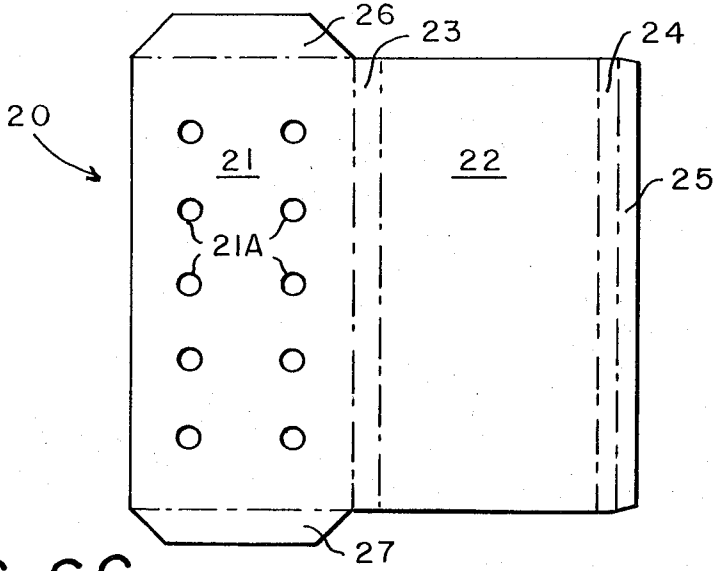
FIG. 6C is a drawing of the boxboard blank from which the removeable bottom tray is made.

FIG. 6C shows the boxboard blank used to construct removable bottom tray 20. Blank 20 is substantially rectangular and includes a pair of oppositely disposed floor panels 21 and 22 and a pair of oppositely disposed floor panel sides 23 and 24, which panels and sides are oppositely disposed in assembled condition and when interlocked by means of floor panel side flange 25. Although any suitable interlocking means is appropriate, the invention prefers a cold glue application on the upper surface of side flange 25 which glue application will rigidly connect floor panel side 24 to the upper floor panel 21 in interlocked condition as shown in FIG. 1B. Upper floor panel 21 additionally includes at least one opening and preferably a plurality of openings as illustrated by 21A to facilitate the circulation of air. Upper floor panel 21 also includes a pair of oppositely disposed end flanges 26 and 27, respectively, which are biased upwardly and outwardly to communicate with carrier carton (rectangular frame) end panels 5 and 7, respectively. While the upper panel end flanges 26 and 27, respectively, may be of other suitable configurations, they are preferably generally rectangular with notched ends to facilitate air circulation and impart rigidity to upper floor panel 21. When interconnected and assembled as shown in FIG. 2, air is permitted to circulate through the interior floor chamber defined by the volume between upper and lower floor panels 21 and 22, respectively, around the end flange notched ends and through openings 21A. At the same, any food droppings from food or other contents placed upon a removable bottom tray 20 are collected on the lower floor panel 21 which also serves to retain heat within the carrier carton. The interconnected panels 21, 22, 23 and 24 can alternatively be described as defining an open ended, rectangularly shaped sleeve-like platform having an upper surface and a lower surface, wherein the lower surface is effectively seated upon the partial bottom support created by the interconnected lower flaps 1A–4A, respectively.

In practice, each of the three component boxboard blanks, namely the carrier carton 10, removable lower tray 20, and removable upper tray 30, shown in FIGS. 6A–C, respectively, are cut, stamped (creased), preglued and interconnected at the place of manufacture. Both the carrier carton 10 and removable bottom tray 20 are collapsible into a fully flattened condition for transportation to the ultimate user where they are easily stored to occupy the least amount of space and readily assembled as both components are self-erecting. Similarly, the removable upper tray 30 is efficiently stored and transported in a nested condition and is easily assembled at its ultimate point of use.

To assemble all three component parts, the ultimate user first selects the stored and flattened carrier container 10 which he rotates into its self-erecting and setup configuration shown in FIG. 1A. The user then inserts the removable bottom tray 20 into the outer container as shown in FIGS. 1B and 2. After placing container contents (e.g. fried food) on removable bottom tray 20, the user then places additional contents on removable upper tray 30. The user then grasps the tray flanges 36 with the thumb and forefinger at alignment hole 36C, lowers the tray into the carrier container 10 while at the same time bringing holes 36C into corresponding alignment with web flap holes 12C and 14C. The user then pulls the overlaid tray flanges (36) and web flaps 16 and 17 outward and downward until the split cover is closed and locked in the web locks 9. The self-erecting handle is automatically brought into upright alignment as shown in FIG. 4. When the split cover is closed, the larger first side cover shoulder members 13B overlap the smaller second side cover shoulder members 15B to prevent contamination from entering the carrier carton 10. Additionally, when side cover panels 13 and 15 are closed, cutout vents 11 in side panels 6 and 8 respectively, automatically pop out and thus form openings with hingedly, closable roofs that both prevent contamination of the carrier carton and permit circulation to prevent interior sogginess. Both the self-erecting handle and the automatic pop out vents 11 can be closed or rendered flat by simple manual depression. This collapsible feature of both the handles and vents facilitates ease in packing and storage.

Deep fried food with a batter topping has a tendency to become very soggy and stick together when packaged in a conventional carryout container. The assembly described above permits the food or other contents to be spread out on separate trays or layers, as opposed to being stocked without separation. Because warm air rises, circulation currents are generated inside the carrier carton which circulate both around and through the carrier carton trays, as well as through the cutout vents. This prevents sogginess of food and container, maintains crispness of the batter and retains good heat retention.

It will be apparent to those skilled in the art that various modifications and variations can be made to the design and structure of the collapsible container without departing from the scope or spirit of the invention. As an example, there can be more than one removable tray by simple adjustment of the container height and of the removable tray end wall dimensions, respectively. Additionally, the partial bottom shown in FIG. 5 can be rendered a full bottom by appropriate adjustments to the end and side panel lower flap 1A–4A dimensions respectively. Thus, it is intended that the present invention cover the modifications and variations of this invention provided they come within the scope of the appended claims and their equivalents.

What is claimed:

1. A folding carrier carton comprised of:

(a) a split cover closure having a pair of oppositely disposed end cover panels wherein at least one of said cover panels includes a substantially triangular shaped web flap, and first and second oppositely disposed side cover panels wherein each of said side cover panels includes corresponding foldable handles adapted to interlock with each other in folded condition, and shoulder members adapted to overlap one another in folded condition wherein the shoulder members of the first side cover panel member are of a lesser dimension than the shoulder members of the second side cover panel;

(b) a substantially rectangular frame interconnected to said split cover closure wherein said frame includes a corresponding pair of oppositely disposed side panels and a corresponding pair of oppositely disposed end panels wherein at least one of said end panels includes a web lock adapted to receive and secure the web flaps from the corresponding split cover panel; and (c) a bottom interconnected to said substantially rectangular frame.

2. A folding carrier carton as defined in claim 1 wherein said bottom is comprised of:

(a) at least one pair of oppositely disposed lower flaps interconnected to said pair of oppositely disposed side panels or end panels in said frame wherein said lower flaps constitute a partial bottom support; and (b) a removable bottom tray of substantially rectangular shape wherein said tray is seated upon said partial bottom support.

3. A folding carrier carton as defined in claim 1 wherein said bottom is comprised of:

(a) lower flaps foldably and integrally connected to each of said oppositely disposed frame side panels and frame end panels wherein said flaps are interconnected in rectangular fashion to form a partial bottom support; and (b) a removable bottom tray of substantially rectangular shape wherein said tray is comprised of a pair of oppositely disposed floor panels and a pair of oppositely disposed floor panel sides, both of said latter pairs being interconnected to form an open ended, rectangularly shaped sleeve like platform having an upper surface and a lower surface wherein said upper surface contains at least one vent opening and a pair of oppositely disposed, upwardly and outwardly biased end flanges communicating with said frame end panels, and wherein said lower surface is seated upon said partial bottom support.

4. A folding carrier carton comprised of:

(a) a split cover closure having a pair of oppositely disposed end cover panels wherein each of said cover panels includes a substantially triangular shaped web flap with an alignment hole, and first and second of oppositely disposed side cover panels wherein each of said side cover panels includes corresponding foldable handles adapted to interlock with each other in folded condition, and shoulder members adapted to overlap one another in folded condition wherein the shoulder members of the first side cover panel member are of a lesser dimension than the shoulder members of the second side cover panel;

(b) a substantially rectangular frame interconnected to said split cover closure wherein said frame includes a corresponding pair of oppositely disposed side panels and a corresponding pair of oppositely disposed end panels wherein each of said end panels includes a web lock adapted to receive and secure the web flap from the corresponding split cover side cover panel;

(c) a bottom interconnected to said substantially rectangular frame; and (d) a removable upper tray comprised of a substantially rectangular bottom panel, a pair of oppositely disposed end walls wherein each of said end walls is of quadrangular shape and a substantially triangular-shaped web flange integrally connected to each end wall wherein each said web flange includes an alignment hole, wherein said triangular-shaped web flange and associated alignment hole are positioned to be aligned with, and overlaid upon, said corresponding cover panel triangularly shaped web flap and associated alignment hole for insertion into said corresponding frame end panel web lock.

5. A folding carrier carton according to claim 4 wherein said removable tray bottom panel is further comprised of a pair of oppositely disposed side walls integrally connected to both said bottom panel and said oppositely disposed end walls, wherein said bottom panel includes at least one vent opening.

6. A folding carrier carton according to claim 4 wherein said carton includes at least two removable trays.

7. A folding carrier carton comprised of:

(a) a split cover closure having a pair of oppositely disposed end cover panels wherein each of said cover panels includes a substantially triangular shaped web flap with an alignment hole, and first and second of oppositely disposed side cover panels wherein each of said side cover panels includes corresponding foldable handles adapted to interlock with each other in folded condition, and shoulder members adapted to overlap one another in folded condition wherein the shoulder members of the first side cover panel member are of a lesser dimension than the shoulder members of the second side cover panel;

(b) a substantially rectangular frame interconnected to said split cover closure wherein said frame includes a corresponding pair of oppositely disposed side panels and a corresponding pair of oppositely disposed end panels wherein each of said end panels includes a web lock adapted to receive and secure the web flap from the corresponding split cover side cover panel;

(c) a bottom interconnected to said substantially rectangular frame wherein said bottom is comprised of:

(1) at least one pair of oppositely disposed flaps interconnected to said pair of oppositely disposed side panels or end panels in said frame wherein said flaps constitute a partial bottom support; and (2) a removable bottom tray of substantially rectangular shape wherein said tray is seated upon said partial bottom support;

(d) A removable upper tray comprised of a substantially rectangular bottom panel, a pair of oppositely disposed end walls wherein each of said end walls is of quadrangular shape and a substantially triangular shaped web flange integrally connected to each end wall wherein each said web flange includes an alignment hole, wherein said triangular shaped web flange and associated alignment hole are positioned to be aligned with, and overlaid upon, said corresponding cover panel triangularly shaped web flap and associated alignment hole for insertion into said corresponding frame end panel web lock.

8. A folding carrier carton comprised of:

(a) a split cover closure having a pair of oppositely disposed end cover panels wherein each of said cover panels includes a substantially triangular shaped web flap with an alignment hole, and first and second oppositely disposed side cover panels wherein each of said side cover panels includes corresponding foldable handles adapted to interlock with each other in folded condition, and shoulder members adapted to overlap one another in folded condition wherein the shoulder members of the first side cover panel member are of a lesser dimension than the shoulder members of the second side cover panel;

(b) a substantially rectangular frame interconnected to said split cover closure wherein said frame includes a corresponding pair of oppositely disposed side panels and a corresponding pair of oppositely disposed end panels wherein each of said end panels includes a web lock adapted to receive and secure the web flap from the corresponding split cover side cover panel;

(c) a bottom interconnected to said substantially rectangular frame wherein said bottom is comprised of:

(1) lower flaps foldably and integrally connected to each of said oppositely disposed frame side panels and frame end panels wherein said lower flaps are interconnected in rectangular fashion to form a partial bottom support; and (2) a removable bottom tray of substantially rectangular shape wherein said tray is comprised of a pair of oppositely disposed floor panels and a pair of oppositely disposed floor panel sides, both of said pairs being interconnected to form an open ended, rectangularly shaped sleeve-like platform having an upper surface and a lower surface wherein said upper surface contains at least one vent opening and a pair of oppositely disposed, upwardly and outwardly biased end flanges communicating with said frame end panels, and wherein said lower surface is seated upon said partial bottom support.

(d) a removable upper tray comprised of a substantially rectangular bottom panel, a pair of oppositely disposed end walls wherein each of said end walls is of quadrangular shape and a substantially triangular shaped web flange integrally connected to each end wall wherein each said web flange includes an alignment hole, wherein said triangular shaped web flange and associated alignment hole are positioned to be aligned with, and overlaid upon, said corresponding cover panel triangularly shaped web flap and associated alignment hole for insertion into said corresponding frame end panel web lock.

* * * * *